US009499245B2

(12) United States Patent
Taylor

(10) Patent No.: US 9,499,245 B2
(45) Date of Patent: Nov. 22, 2016

(54) BOAT PROPELLER NUT

(71) Applicant: Guy Taylor, Duchesne, UT (US)

(72) Inventor: Guy Taylor, Duchesne, UT (US)

( * ) Notice: Subject to any disclaimer, the term of this patent is extended or adjusted under 35 U.S.C. 154(b) by 481 days.

(21) Appl. No.: 14/079,398

(22) Filed: Nov. 13, 2013

(65) Prior Publication Data

US 2015/0132145 A1 May 14, 2015

(51) Int. Cl.
*B63H 23/24* (2006.01)
*B63H 1/28* (2006.01)

(52) U.S. Cl.
CPC ..... *B63H 1/28* (2013.01); *B63H 2001/283* (2013.01)

(58) Field of Classification Search
CPC .... B63H 1/28; B63H 2001/283; F04D 29/04
See application file for complete search history.

(56) References Cited

U.S. PATENT DOCUMENTS 1,851,513 A * 3/1932 Holmstrom ..... B64C 11/00 123/41.7
2,477,521 A * 7/1949 Martin ..... F16D 7/044 416/169 R
3,382,838 A * 5/1968 Abdon Bergstedt ... B63H 20/22 416/134 R
3,504,990 A * 4/1970 Sugden ..... B63H 1/16 415/124.1
3,600,102 A * 8/1971 Dirlik ..... B63H 3/08 416/154
3,792,938 A * 2/1974 Wilde ..... B63H 23/34 416/146 R
3,905,719 A * 9/1975 Minnich ..... B63H 1/18 415/126
4,341,503 A * 7/1982 Gschwender ..... F04D 29/106 415/112
5,415,575 A * 5/1995 Karls ..... B63H 23/30 192/54.1
7,025,642 B1 * 4/2006 Baylor ..... B63H 1/20 416/197 R

* cited by examiner

*Primary Examiner* — Igor Kershteyn
(74) *Attorney, Agent, or Firm* — Kirton McConkie; Evan R. Witt

(57) ABSTRACT

A propeller nut designed to replace a conventional hexagonal nut to secure a boat propeller to a motor. The propeller nut includes a leading portion and a trailing portion. The leading portion has a nut part having internal threads sized and configured to engage external threads of a drive shaft and to secure the boat propeller about the drive shaft and a diverging part extending outwardly from the nut part to a maximum outer circumference. The trailing portion extends from the maximum outer circumference to a trailing end of the propeller nut, wherein the trailing portion has an outer surface that converges from the maximum outer circumference to the trailing end.

10 Claims, 7 Drawing Sheets

BOAT PROPELLER NUT

BACKGROUND OF THE INVENTION

The disclosed invention relates generally to nut for securing a boat propeller to a motor. More specifically, the disclosed invention relates to a propeller nut for use with a through-hub exhaust propeller.

The propeller of many motorized boats that have an outboard motor or an inboard/outboard motor typically rests below the bottom surface of the boat, at or near the boat's trailing end (or stern), when the propeller is in use. Accordingly, as the propeller spins, it is able to propel the boat through the water.

A typical propeller includes a plurality of curved blades attached to a hub. Most recreational boat propellers are available in 3, 4, and 5 blade configurations. The propeller blades are curved relative to the hub. The hub is the cylindrical portion at the center of the propeller to which each propeller blade is attached. The center of the hub includes a concentric core that is sized to securely fit over a drive shaft extending from the boat motor transmission. Through-hub exhaust propellers include an open barrel hub that serves as an outlet for motor exhaust to escape without making blade contact, thereby improving acceleration.

The drive shaft includes external threads on a trailing end thereof. The propeller is secured to the motor drive shaft using a propeller nut having internal threads sized and configured to engage the external threads on the drive shaft and to secure the boat propeller about the drive shaft. The propeller nut is usually a conventional hexagonal nut.

Boat owners and operators are often interested in improving boat performance such as acceleration and top speed.

Accordingly, it would be an improvement in the art to provide a propeller nut that provides improved boat performance.

BRIEF SUMMARY OF THE INVENTION

This disclosure discusses a propeller nut having a unique shape and configuration. In some non-limiting implementations, the propeller nut has been shown to improve boat performance.

One propeller nut disclosed herein extends in a longitudinal direction. The propeller nut includes a leading portion and a trailing portion.

The leading portion has a nut part and a frustoconical part. The nut part has internal threads sized and configured to engage complimentary external threads of a drive shaft and to secure the boat propeller about the drive shaft. The drive shaft extends from the boat motor transmission. The frustoconical part extends outwardly from the nut part to a maximum outer circumference of the propeller nut.

The trailing portion extends from the maximum outer circumference to a trailing end of the propeller nut. The trailing portion has a conical or conoidal outer surface.

As used herein, the term "leading end" means the end closest to the bow (or front) of the boat. As used herein, the term "trailing end" means the end closest to the stern (or rear) of the boat. As used herein, the term "conical shape" means having the shape of a cone. Typically a conical shape will have a longitudinal cross-section with a straight outer surface. As used herein, the term "conoidal shape" means having a shape resembling a cone. Typically a conoidal shape will have a longitudinal cross-section with a curved outer surface.

In some non-limiting embodiments, the propeller nut comprises a hole extending through the trailing portion in a direction transverse to the longitudinal direction.

In some non-limiting embodiments, the propeller nut comprises grooves cut into the outer surface of the trailing portion. In some non-limiting embodiments, the grooves are cut in a curved direction. In some non-limiting embodiments, the grooves are cut in a curved direction corresponding generally to a curvature of propeller blades on the boat propeller.

In some non-limiting embodiments, the propeller nut comprises a plurality of notches spaced around the maximum circumference. In some embodiments, the notches have been shown to improve boat performance.

In some non-limiting embodiments, the trailing portion of the propeller nut comprises a rough or irregular surface to promote turbulent fluid flow over the trailing portion. In some embodiments, the rough or irregular surface has been shown to improve boat performance.

In some non-limiting embodiments, the boat propeller comprises a hub through which motor exhaust passes. When the propeller nut engages the drive shaft to secure the boat propeller, there is a gap between the maximum outer circumference and a deflector ring located at a trailing end of the propeller. The gap is sufficiently large to permit flow of motor exhaust out the propeller hub and around the propeller nut.

These features and advantages of the present invention will become more fully apparent from the following description and appended claims, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained and will be readily understood, a more particular description of the invention briefly described above will be rendered by reference to specific embodiments thereof that are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner and in one or more embodiments. In the following description, numerous specific details are provided of features associated with suitable propeller nuts to provide a thorough understanding of embodiments of the invention. One skilled in the relevant art will recognize, however, that the invention may be practiced without one or more of the specific details or methods, or with other methods, components, characteristics, materials, and so forth. In other instances, well-known structures, materials, or operations are not shown or described in detail to avoid obscuring aspects of the invention.

The embodiments of the present invention will be best understood by reference to the drawings, wherein like parts are designated by like numerals throughout. It will be readily understood that the components of the present invention, as generally described and illustrated in the Figures herein, could be arranged and designed in a wide variety of different configurations. Thus, the following more detailed description of the embodiments of the propeller shield as represented in FIGS. 1 through 9, is not intended to limit the scope of the invention, as claimed, but is merely representative of some embodiments of the invention.

This disclosure discusses a boat propeller nut that is designed to replace a conventional hexagonal propeller nut to secure a propeller to a drive shaft. Surprisingly, it has been observed that certain features and characteristics of the propeller nut appear to improve boat performance.

The propeller nut disclosed herein can be connected to any suitable type of boat propeller. In this regard, some examples of suitable types of boat propellers include, but are not limited to, boat propellers associated with outboard motors, boat propellers associated with indoor/outdoor motors, and other boat propellers located at or near the stern. In some non-limiting embodiments, the disclosed propeller nut is connected to a through-hub exhaust boat propeller.

Figure 1:
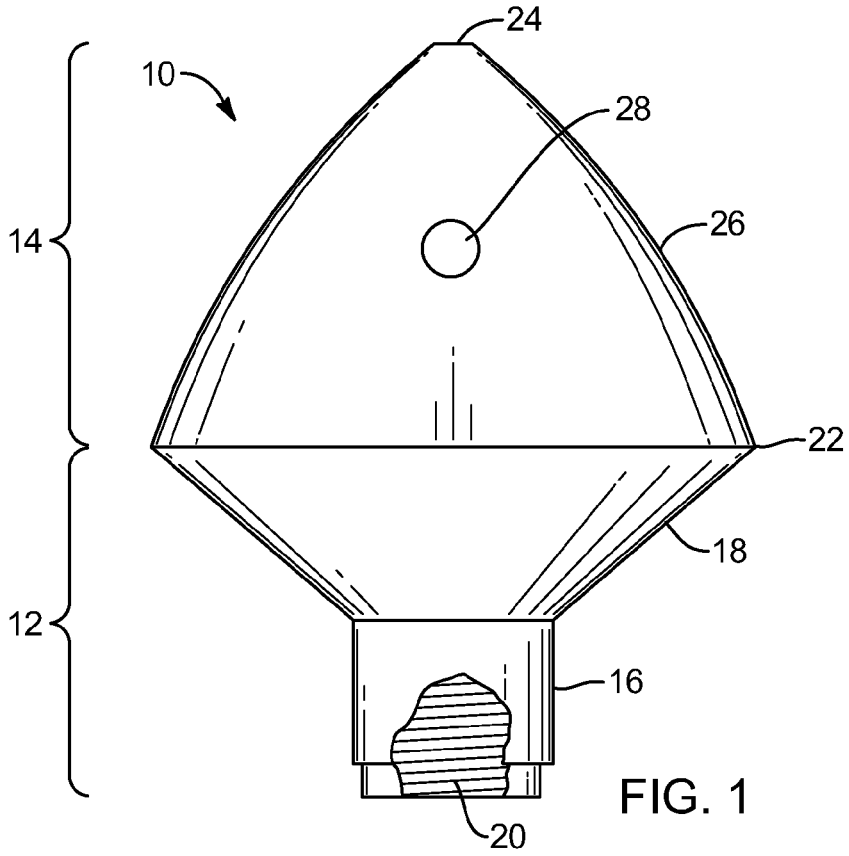
FIG. 1 illustrates a side view, partially cut away, of a representative embodiment of a propeller nut.
Figure 2:
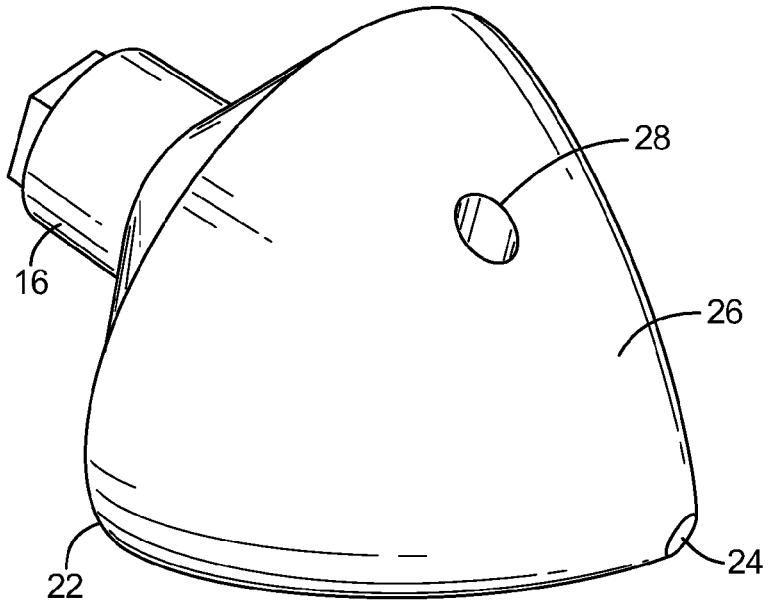
FIG. 2 illustrates a perspective side and trailing end view of the propeller nut of FIG. 1.
Figure 3:
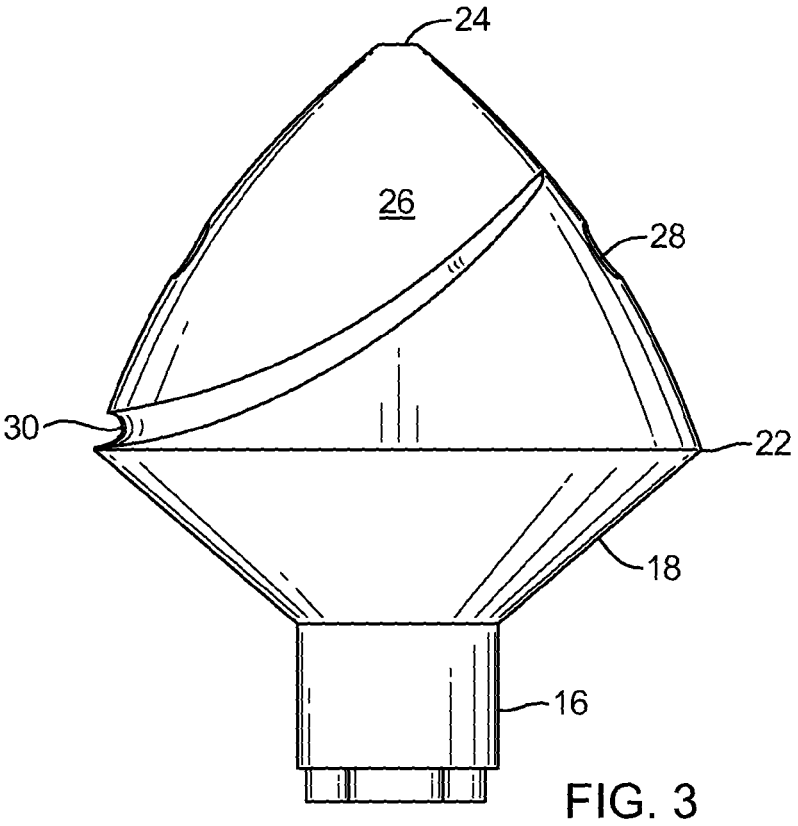
FIG. 3 illustrates a side view of a representative embodiment of a propeller nut having a curved groove on the outer surface of the trailing portion.
Figure 4:
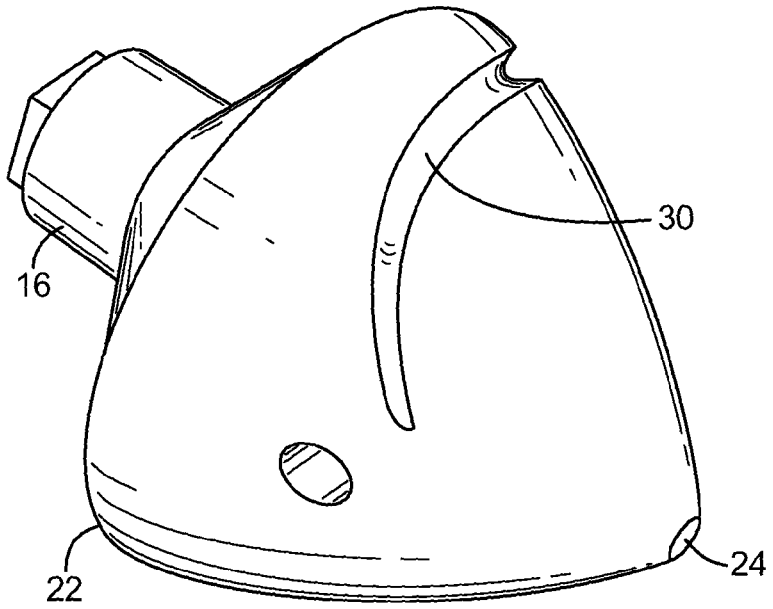
FIG. 4 illustrates a perspective side and trailing end view of the propeller nut of FIG. 3.
Figure 5:
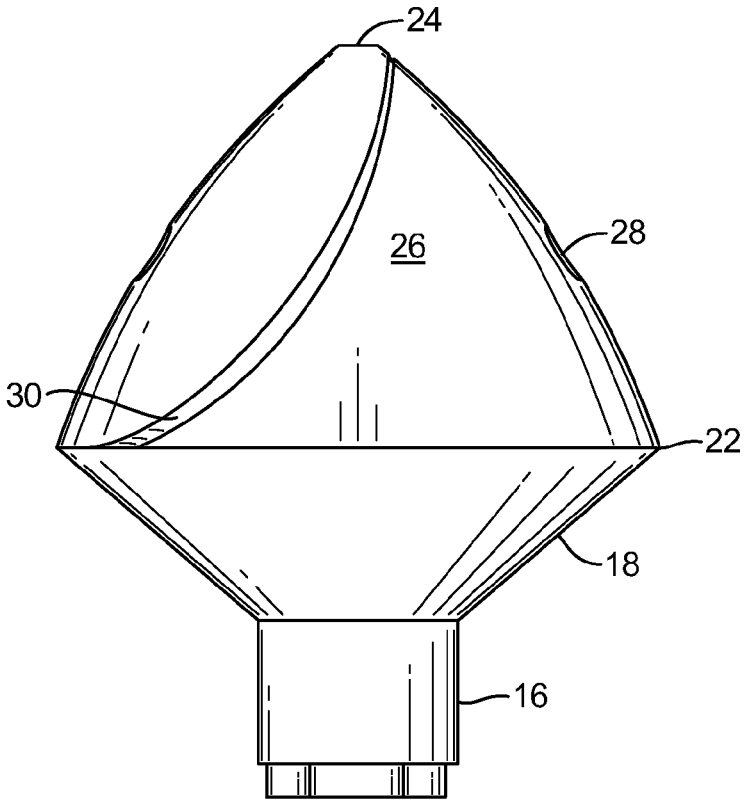
FIG. 5 illustrates a side view of a representative embodiment of a propeller nut having a curved groove on the outer surface of the trailing portion.
Figure 6:
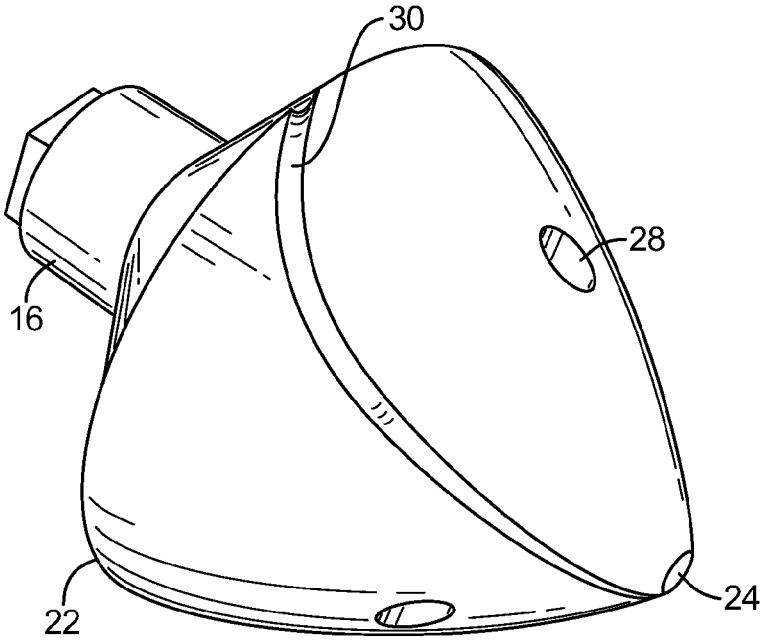
FIG. 6 illustrates a perspective side and trailing end view of the propeller nut of FIG. 5.

By way of illustration, FIG. 1 illustrates a non-limiting embodiment of a propeller nut 10. The propeller nut includes a leading portion 12 and a trailing portion 14.

The leading portion 12 has a nut part 16 and a diverging part 18. The nut part has internal threads 20 sized and configured to engage complimentary external threads of a drive shaft 21 (shown in FIG. 11) and to secure a boat propeller about the drive shaft. The drive shaft extends from the boat motor transmission. The diverging part 18 extends outwardly from the nut part 16 to a maximum outer circumference 22 of the propeller nut. In some embodiments, the diverging part 18 has a frustoconical shape.

The trailing portion 14 extends from the maximum outer circumference 22 to a trailing end 24 of the propeller nut. In some embodiments, the trailing end 24 has flat or rounded surface. The trailing portion 14 has an outer surface 26 that converges from the maximum outer circumference 22 to the trailing end 24. In some embodiments, the trailing portion 14 has a conical or conoidal outer surface 26.

In some non-limiting embodiments, the propeller nut 10 comprises a hole 28 extending through the trailing portion in a direction transverse to the longitudinal direction. The hole 28 is preferably sized to receive a tool to tighten and engage the propeller nut relative to the drive shaft.

As shown in FIGS. 3-6, in some non-limiting embodiments, the propeller nut 10 comprises grooves 30 cut into the outer surface 26 of the trailing portion 14. In some non-limiting embodiments, the grooves 30 are cut in a curved direction. The curvature of grooves 30 shown in FIGS. 3 and 4 differs from the curvature of grooves 30 shown in FIGS. 5 and 6. In some non-limiting embodiments, the grooves are cut in a curved direction corresponding generally to a curvature of propeller blades on the boat propeller.

Figure 7:
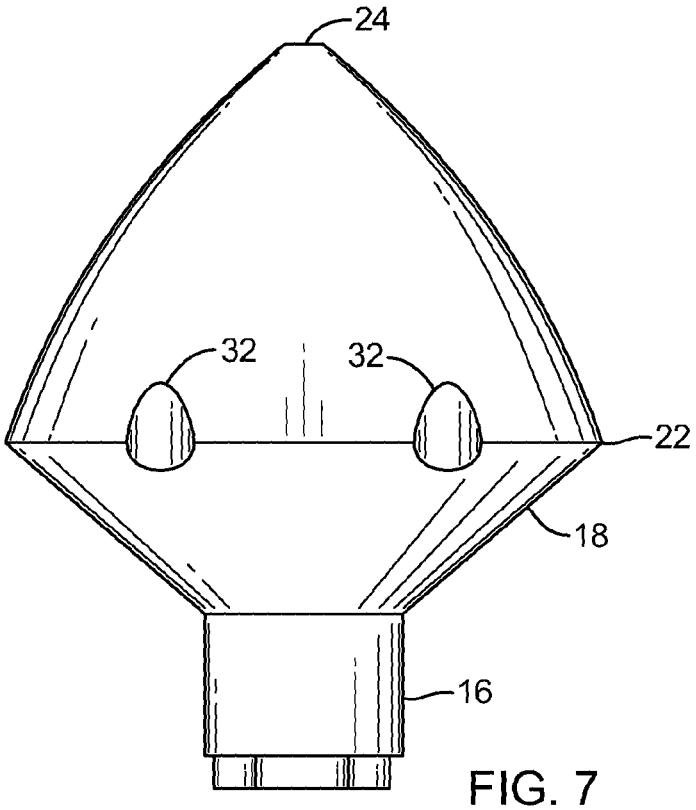
FIG. 7 illustrates a side view of a representative embodiment of a propeller nut having notches on the maximum outer circumference.
Figure 8:
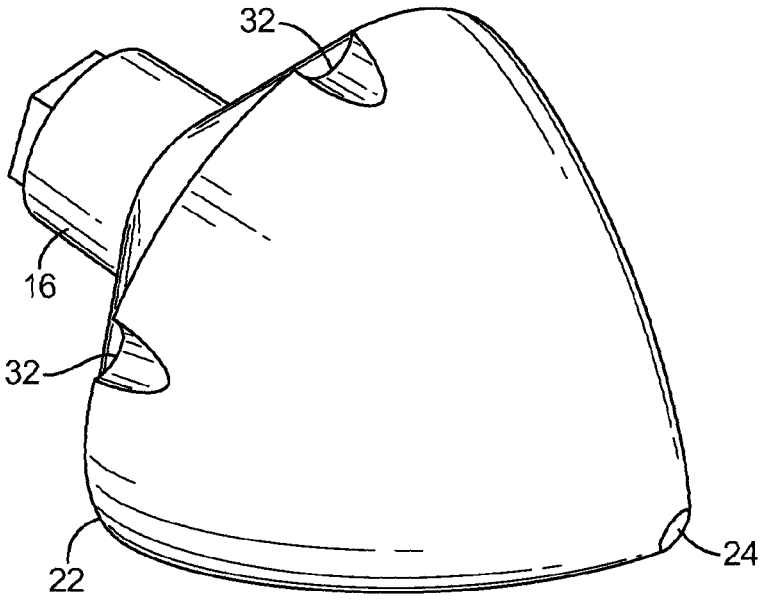
FIG. 8 illustrates a perspective side and trailing end view of the propeller nut of FIG. 7.

As shown in FIGS. 7-8, in some non-limiting embodiments, the propeller nut comprises a plurality of notches 32 spaced around the maximum outer circumference 22. In some embodiments, the notches 32 have been shown to improve boat performance.

In some non-limiting embodiments, the trailing portion 14 of the propeller nut comprises a rough or irregular surface to promote turbulent fluid flow over the trailing portion. In some embodiments, the rough or irregular surface has been shown to improve boat performance.

Figure 9:
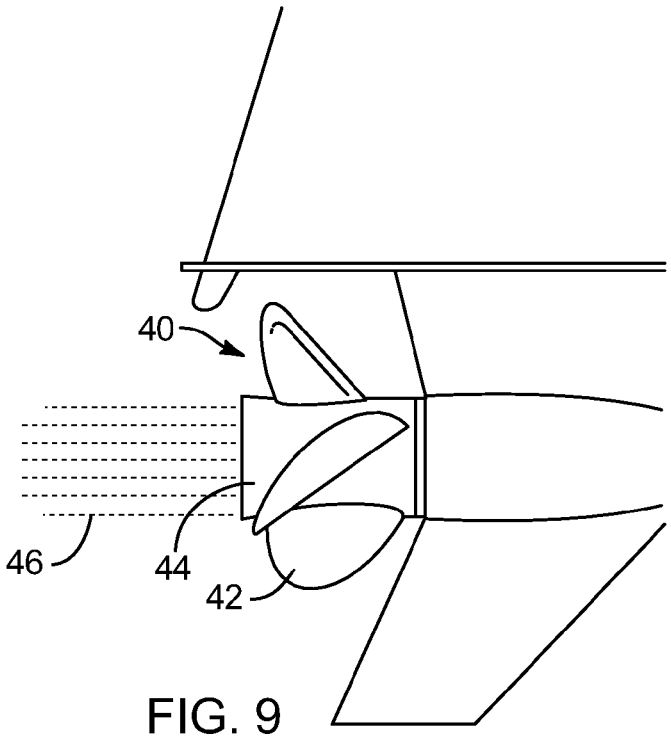
FIG. 9 is a side view of a through-hub exhaust boat propeller.
Figure 10:
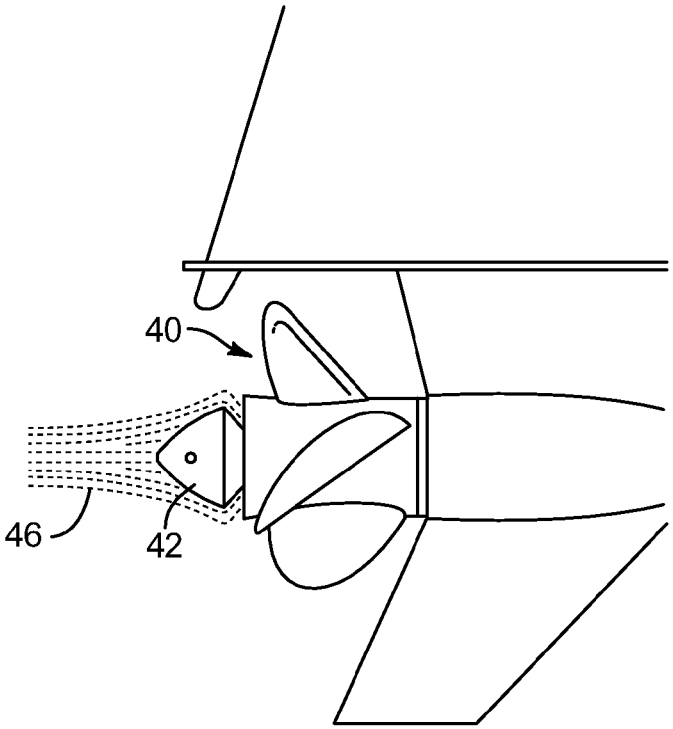
FIG. 10 is a side view of a through-hub exhaust boat propeller in combination with a propeller nut as disclosed herein.

FIG. 9 is a side view of a through-hub exhaust boat propeller 40. The propeller 40 includes a plurality of curved blades 42 attached to a hub 44. Motor exhaust 46 passes through the hub 44. FIG. 10 is a side view of a through-hub exhaust boat propeller 40 in combination with a propeller nut 10 disclosed herein.

Figure 11:
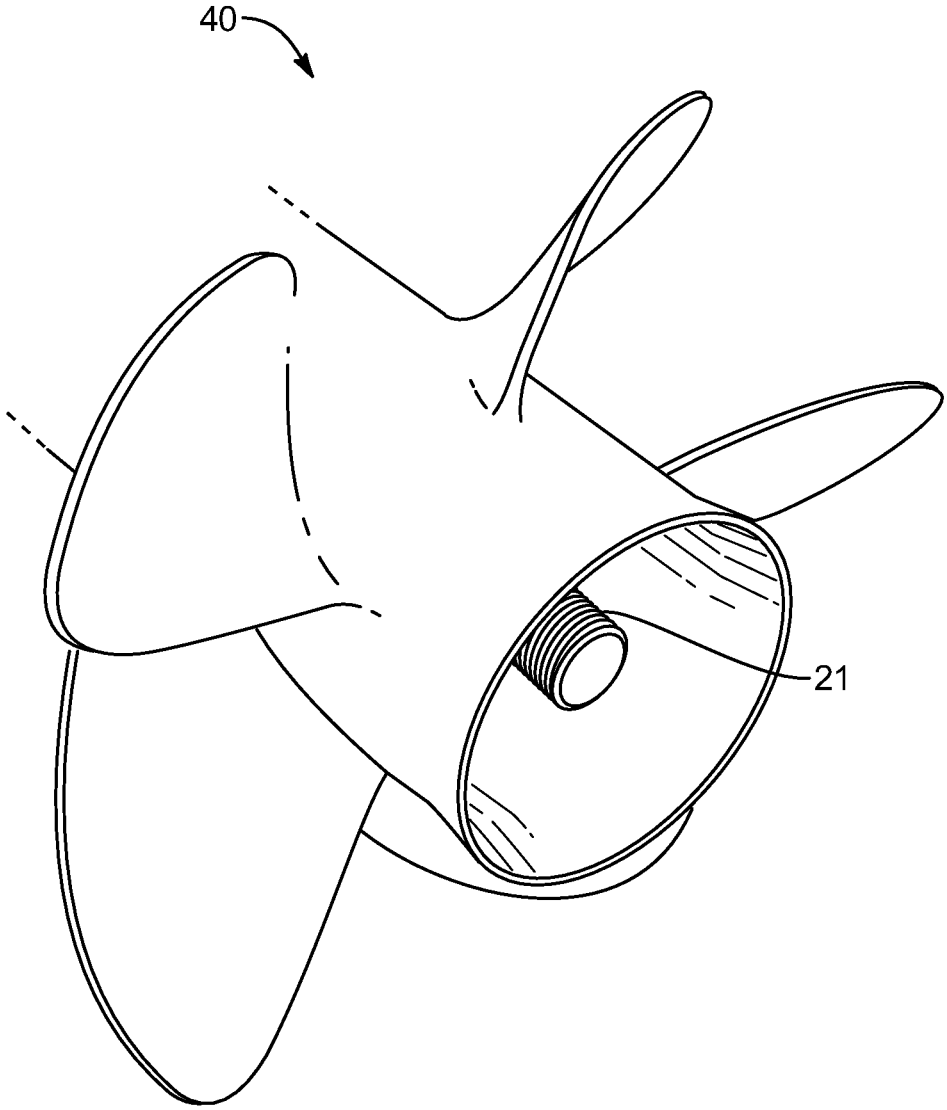
FIG. 11 is a perspective view of a through-hub exhaust boat propeller without a propeller nut.
Figure 12:
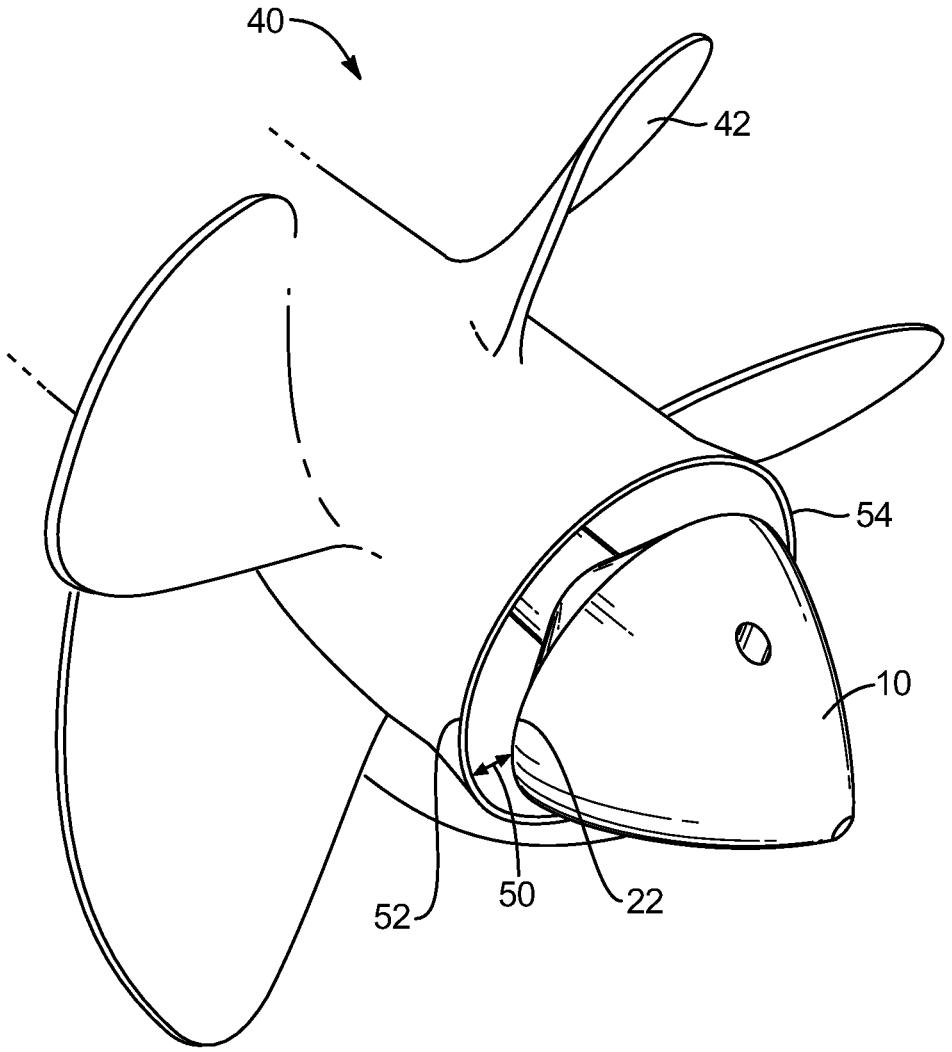
FIG. 12 is a perspective view of a through-hub exhaust boat propeller in combination with a propeller nut.

FIG. 11 is a perspective view of the through-hub exhaust boat propeller 40 with no propeller nut. FIG. 12 is a perspective view of the through-hub exhaust boat propeller 40 in combination with a propeller nut 10.

When the propeller nut engages the drive shaft to secure the boat propeller, there is a gap 50 between the maximum outer circumference 22 and a deflector ring 52 located at a trailing end 54 of the propeller 40. The gap 50 is sufficiently large to permit flow of motor exhaust 56 out the propeller hub 44 and around the propeller nut 10, as shown in FIG. 12.

Without being bound by theory, it is presently believed that the unique shape and configuration of the propeller nut causes motor exhaust to closely follow the surface contour of the propeller nut such that the motor exhaust is focused to a concentrated trail as the propeller drives the boat through the water.

The propeller nut may be manufactured of any suitable material which can withstand extended exposure to water without corrosion or damage. In one embodiment, the propeller nut is manufactured of a marine grade metal or metal alloy. In one embodiment, the propeller nut is manufactured of aluminum.

EXAMPLE

In order to evaluate the effect of the described propeller nut 10 on the performance of a boat, several performance characteristics for a boat using the propeller nut were measured and compared against the performance characteristics measured from the same boat without the propeller nut. Only the change in performance using the propeller nut is reported in Table 1.

TABLE 1

| Performance Characteristic | Performance Change With Propeller Nut |
|---|---|
| 0-25 mph Acceleration Time | +1 second |
| 25-40 mph Acceleration Time | −2.8 seconds (straight trailing end outer surface) |
| Top Speed | +0.5 mph (straight trailing end outer surface) |
| Top Speed | +0.8 mph (curved trailing end outer surface) |
| Top Speed | +1.3 mph (grooved trailing end outer surface) |
| Top Speed | +1.5 mph (notched maximum outer circumference) |

Without being bound by theory, it is presently believed that the improved high speed acceleration is attributed to a flywheel effect caused by the propeller nut within the scope of the present invention. This phenomenon provides increased torque when operating the boat.

While specific embodiments of the present invention have been illustrated and described, numerous modifications come to mind without significantly departing from the spirit of the invention, and the scope of protection is only limited by the scope of the accompanying claims and not by any of the aforementioned embodiments or examples.

The invention claimed is:

1. A propeller nut extending in a longitudinal direction for securing a boat propeller to a motor, wherein the boat propeller comprises a hub through which engine exhaust passes, the propeller nut comprising:

a leading portion comprising:

a nut part having internal threads sized and configured to engage external threads of a drive shaft and to secure the boat propeller about the drive shaft; and a diverging part extending outwardly from the nut part to a maximum outer circumference; and a trailing portion extending from the maximum outer circumference to a trailing end of the propeller nut, wherein the trailing portion has an outer surface that converges from the maximum outer circumference to the trailing end.

2. The propeller nut according to claim 1, wherein the diverging part has a frustoconical shape.

3. The propeller nut according to claim 1, wherein the outer surface of the trailing portion has a conical or conoidal shape.

4. The propeller nut according to claim 1, further comprising a plurality of notches spaced around the maximum circumference.

5. The propeller nut according to claim 1, wherein the trailing portion comprises a rough or irregular surface to promote turbulent fluid flow over the trailing portion.

6. The propeller nut according to claim 1, wherein when said propeller nut engages the drive shaft to secure the boat propeller, there is a gap between the maximum outer circumference and a deflector ring located at a trailing end of the propeller, wherein the gap is sufficiently large to permit flow of engine exhaust out the propeller hub and around the propeller nut.

7. A propeller nut extending in a longitudinal direction for securing a boat propeller to a motor comprising;

a leading portion comprising:

a nut part having internal thread sized and configured to engage external threads of a drive shaft and to secure the boat propeller about the drive shaft; and a diverging part extending outwardly from the nut part to a maximum outer circumference;

a trailing portion extending from the maximum outer circumference to a trailing end of the propeller nut, wherein the trailing portion has an outer surface that converges from the maximum outer circumference to the trailing end; and a hole extending through the trailing portion in a direction transverse to the longitudinal direction.

8. A propeller nut extending in a longitudinal direction for securing a boat propeller to a motor comprising:

a leading portion comprising:

a nut part having internal threads sized and configured to engage external threads of a drive shaft and to secure the boat propeller about the drive shaft; and a diverging part extending outwardly from the nut part to a maximum outer circumference;

a trailing portion extending from the maximum outer circumference to a trailing end of the propeller nut, wherein the trailing portion has an outer surface that converges from the maximum outer circumference to the trailing end; and grooves cut into the outer surface of the trailing portion.

9. The propeller nut according to claim 8, wherein the grooves are cut in a curved direction.

10. The propeller nut according to claim 9, wherein the grooves are cut in a curved direction corresponding generally to a curvature of propeller blades on the boat propeller.

* * * * *